US006968891B2

(12) United States Patent
Tochigi et al.

(10) Patent No.: US 6,968,891 B2
(45) Date of Patent: Nov. 29, 2005

(54) LOUVER FIN AND CORRUGATION CUTTER FOR FORMING LOUVER FIN

(75) Inventors: Kenji Tochigi, Tokyo (JP); Hirokazu Yaezawa, Tokyo (JP); Takahiro Nakakomi, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 235 days.

(21) Appl. No.: 10/383,240

(22) Filed: Mar. 7, 2003

(65) Prior Publication Data

US 2004/0011516 A1 Jan. 22, 2004

(30) Foreign Application Priority Data

Mar. 7, 2002 (JP) ..... P2002-062109

(51) Int. Cl.[7] ..... F28F 1/22
(52) U.S. Cl. ..... 165/152; 29/890.03
(58) Field of Search ..... 165/152; 72/379.6

(56) References Cited

U.S. PATENT DOCUMENTS 3,724,538 A * 4/1973 Yamaguchi et al. ..... 165/152
4,464,920 A * 8/1984 Stoehr et al. ..... 72/186
2002/0124404 A1 * 9/2002 Morihira et al. ..... 29/890.03

FOREIGN PATENT DOCUMENTS

JP 57070395 A * 4/1982 ..... F28F 1/30
JP 05106986 A * 4/1993 ..... F28F 1/30
JP 06082187 A * 3/1994 ..... F28F 1/30

* cited by examiner

*Primary Examiner*—Allen J. Flanigan
(74) *Attorney, Agent, or Firm*—Foley & Lardner LLP

(57) ABSTRACT

A virtual quadrangle having vertexes respectively configured by: inner ends which are located respectively at a corner of inner cut end faces of the louvers formed in flat portions that are opposed to each other across the bent portion; and outer ends which are located respectively at a corner of outer cut end faces of the louvers, is assumed. A distortion adjusting portion is disposed in the bent portion of the louver fin. The distortion adjusting portion equalizes distortion generated in the direction of an inner diagonal line connecting the inner ends of the virtual quadrangle, with that generated in the direction of an outer diagonal line connecting the outer ends of the virtual quadrangle. Thereby, the louver fin can be prevented from being curved in the longitudinal direction.

5 Claims, 17 Drawing Sheets

LOUVER FIN AND CORRUGATION CUTTER FOR FORMING LOUVER FIN

The present disclosure relates to the subject matter contained in Japanese Patent Application No. 2002-062109 filed on Mar. 7, 2002, which is incorporated herein by reference in its entirety.

BACKGROUND OF THE INVENTION

1. Field of the Invention

The present invention relates to a heat radiating louver fin for a heat exchanger, and more particularly to a louver fin in which a strip thin sheet is formed into a corrugated shape configured alternately and continuously by bent portions and flat portions where louvers are formed, and also to a corrugation cutter for forming such a louver fin.

2. Description of the Related Art

A heat exchanger such as a radiator mounted on an internal combustion engine vehicle, or that such as a heater core, a condenser, or an evaporator of an air conditioner is configured so as to efficiently perform the heat exchange function with the outside air via fins disposed in the heat exchanger.

FIG. 15 shows a conventional fin 1. A strip thin sheet 2 is formed by using a corrugation cutter (not shown) into a louver fin wherein a corrugated shape (bellows-like shape) in which bent portions 1*a* and flat portions 1*b* are alternately continued, and a plurality of louvers 3 are punched and raised in each of the flat portions 1*b* along the longitudinal direction Y of the strip thin sheet 2 to be arranged in the width direction X of the strip thin sheet 2.

When the louvers 3 are punched and raised in the louver fin 1, as shown in FIG. 16, the distortion amount of an outer cut end 3*b* of each of the bent portions 1*a* is larger than that of an inner cut end 3*a*. Such distortion amounts of the bent portions are accumulated in the longitudinal direction of the louver fin 1. As a result, apex twist occurs in the bent portions 1*a,* and the whole of the louver fin 1 is curved and rounded as shown in FIG. 17.

When the louver fin 1 is rounded as described above, there becomes impossible to mount the louver fin on a heat exchanger. As shown in FIG. 15, conventionally, the louvers 3 formed in each of the flat portions 1*b* are therefore divided into groups A and B so that raised directions of the louvers are symmetrical in the width direction X of the strip thin sheet 2. The louvers 3 of the group A are opened toward the front side, and the louvers 3 of the group B are opened toward the rear side, whereby the distortion amounts due to the punching and raising process are uniformalized in the width direction X so as to maintain the linearity of the louver fin 1.

When the louvers 3 in each of the flat portions 1*b* are punched and raised in different directions or opened in different directions, however, the airflow passes through the louver fin 1 with following a meandering path, so that the flow resistance is increased and hence the amount of passing air is reduced to lower the heat exchange efficiency.

SUMMARY OF THE INVENTION

It is therefore an object of the invention to provide a louver fin in which the whole fin is prevented from being curved irrespective of the raised directions of louvers, and also a corrugation cutter for forming such a louver fin.

According to a first aspect of the invention, there is provided a louver fin in which a strip thin sheet is formed into a continuous corrugated shape configured by alternate bent portions and flat portions, and, in each of the flat portions, a plurality of louvers that are punched and raised along a longitudinal direction of the strip thin sheet are arranged in a width direction of the strip thin sheet, including: a distortion adjusting portion disposed in each of the bent portions, wherein a virtual quadrangle being assumed, the virtual quadrangle having vertexes respectively configured by: inner ends which are located respectively at a corner of inner cut end faces of the louvers formed in flat portions that are opposed to each other across the bent portion; and outer ends which are located respectively at a corner of outer cut end faces of the louvers, wherein the distortion adjusting portion equalizes a distortion generated in a direction of an inner diagonal line connecting said inner ends of the virtual quadrangle, with distortion generated in a direction of an outer diagonal line connecting said outer ends.

According to the first aspect of the invention, the amounts of distortions which are caused in the bent portion by punching and raising the louvers can be equalized with each other in the width direction of the strip thin sheet by the distortion adjusting portion that is disposed in a tip end face of the bent potion, so that the louver fin can be prevented from being curved in the longitudinal direction and the linearity can be maintained. Therefore, the louver fin can be mounted on a heat exchanger easily and accurately without providing a mounting machine with extra means, resulting in that heat exchangers can be mass-produced.

The distortion adjusting portion in the first aspect of the invention, may be configured by embosses, openings or debosses. In this configuration, the strip thin sheet can be deformed so that the internal stress on the inner diagonal line is equalized with that on the outer diagonal line by the embosses, openings or debosses. When the louver fin is subjected to the punching and raising process, therefore, the distortion amounts in the directions of the inner and outer diagonal lines can be substantially equalized with each other, whereby the louver fin can be prevented from being curved.

According to a second aspect of the invention, there is provided a louver fin in which a strip thin sheet is formed into a continuous corrugated shape configured by alternate bent portions and flat portions, and, in each of the flat portions, a plurality of louvers that are punched and raised along a longitudinal direction of the strip thin sheet are arranged in a width direction of the strip thin sheet, wherein a width of each of the bent portions is changed in a direction along which curve of said fin is corrected in the width direction of the strip thin sheet.

According to the second aspect of the invention, the width of each of the bent portions is changed in the following manner. The width of the bent portion is increased in a direction along which curve of the strip thin sheet is corrected, i.e., in the side of bent portion potion in which the curvature of the fin is larger, and that of the outer side of the bent portion in which the curvature is smaller is reduced, whereby the louver fin can be prevented from being curved.

According to a third aspect of the invention, there is provided a louver fin in which a strip thin sheet is formed into a continuous corrugated shape configured by alternate bent portions and flat portions, and, in each of the flat portions, a plurality of louvers that are punched and raised along a longitudinal direction of the strip thin sheet are arranged in a width direction of the strip thin sheet, wherein a pair of louvers which are each formed in a pair of flat portions that are opposed to each other across one of the bent portions, are raised at the opposite direction symmetrically about the bent portion.

According to the third aspect of the invention, the raised directions of the louvers which are formed in the flat portions that are opposed to each other across the bent portion are symmetrical about the bent portion, whereby distortions which are generated outside raised parts of the louvers in the opposed flat portions can be offset against each other. Therefore, the louver fin can be prevented from being curved.

According to a fourth aspect of the invention, there is provided a corrugation cutter for forming a corrugated louver fin in which a strip thin sheet is formed into a continuous corrugated shape configured by alternate bent portions and flat portions, and, in each of the flat portions, a plurality of louvers that are punched and raised along a longitudinal direction of the strip thin sheet are arranged in a width direction of the strip thin sheet, including: a plurality of radially protruded teeth for continuously forming the bent portions at predetermined intervals in the strip thin sheet; a plurality of raising edges formed on side faces of the teeth for punching and raising the louvers in each of the flat portions of the strip thin sheet, thereby forming the louvers to be elongating along a longitudinal direction of the strip thin sheet and arranged in a width direction of the strip thin sheet; and a distortion adjusting portion forming section disposed in each of an apex portion of the teeth and in each of a bottom portion between the teeth, for forming a distortion adjusting portion for correcting a curvature of the louver fin, in each of the bent portions.

According to the fourth aspect of the invention, a distortion adjusting portion forming section is disposed in each of the apexes and the bottoms of the radially protruded teeth. When a louver fin is to be formed by rotating the corrugation cutter, therefore, bent portions are formed in the strip thin sheet by the apexes and the bottoms, and at the same time the distortion adjusting portion for correcting curve of the fin is formed in each of the bent portions. As a result, the step of preventing the fin from being curved can be realized by the step of shaping the corrugation, and hence the productivity of a louver fin can be improved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, there is shown a preferred embodiment of the invention.

[First Embodiment]

Figure 1:
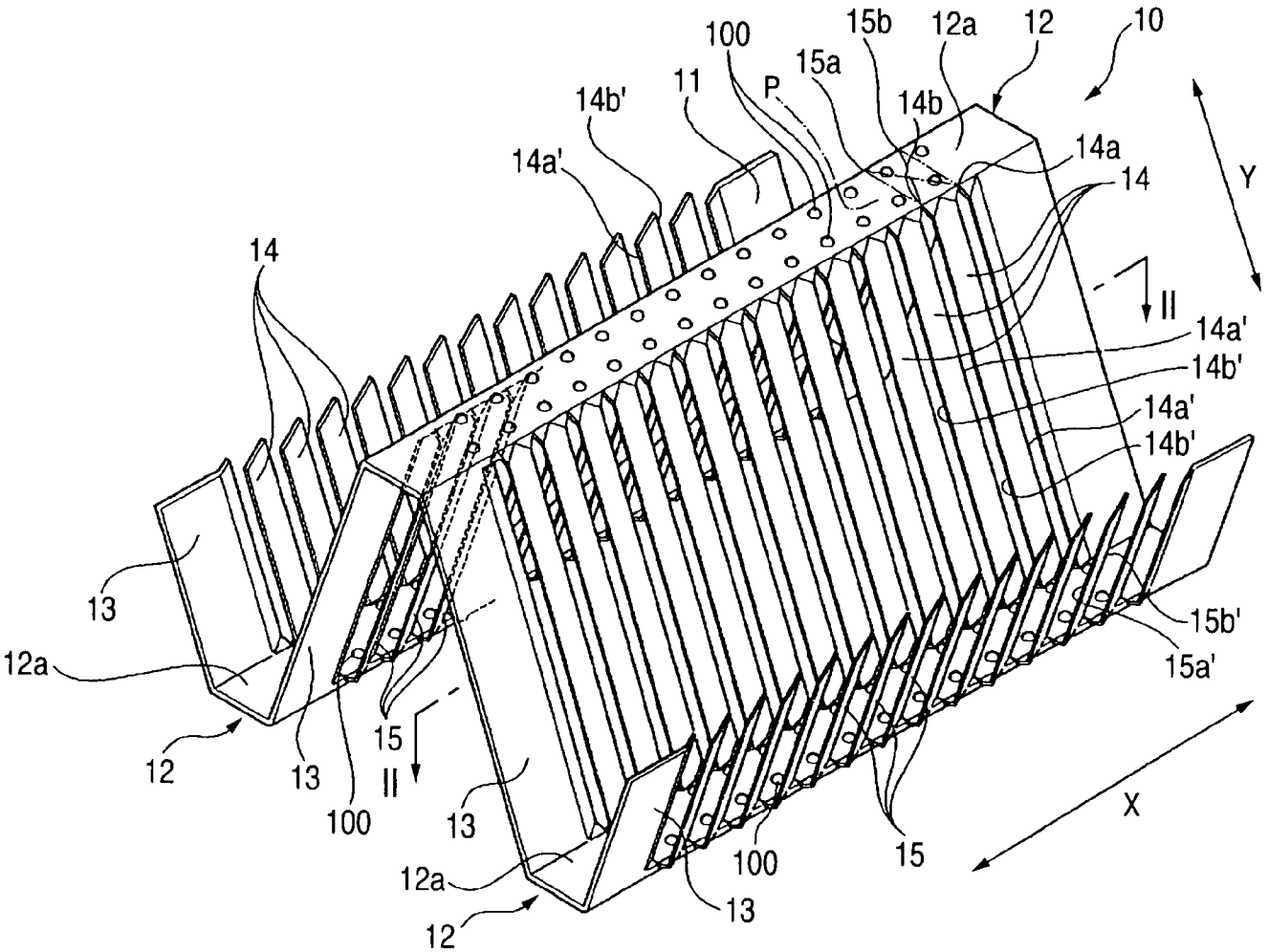
FIG. 1 is a perspective view showing a part of a louver fin in a first embodiment of the invention.
Figure 2:
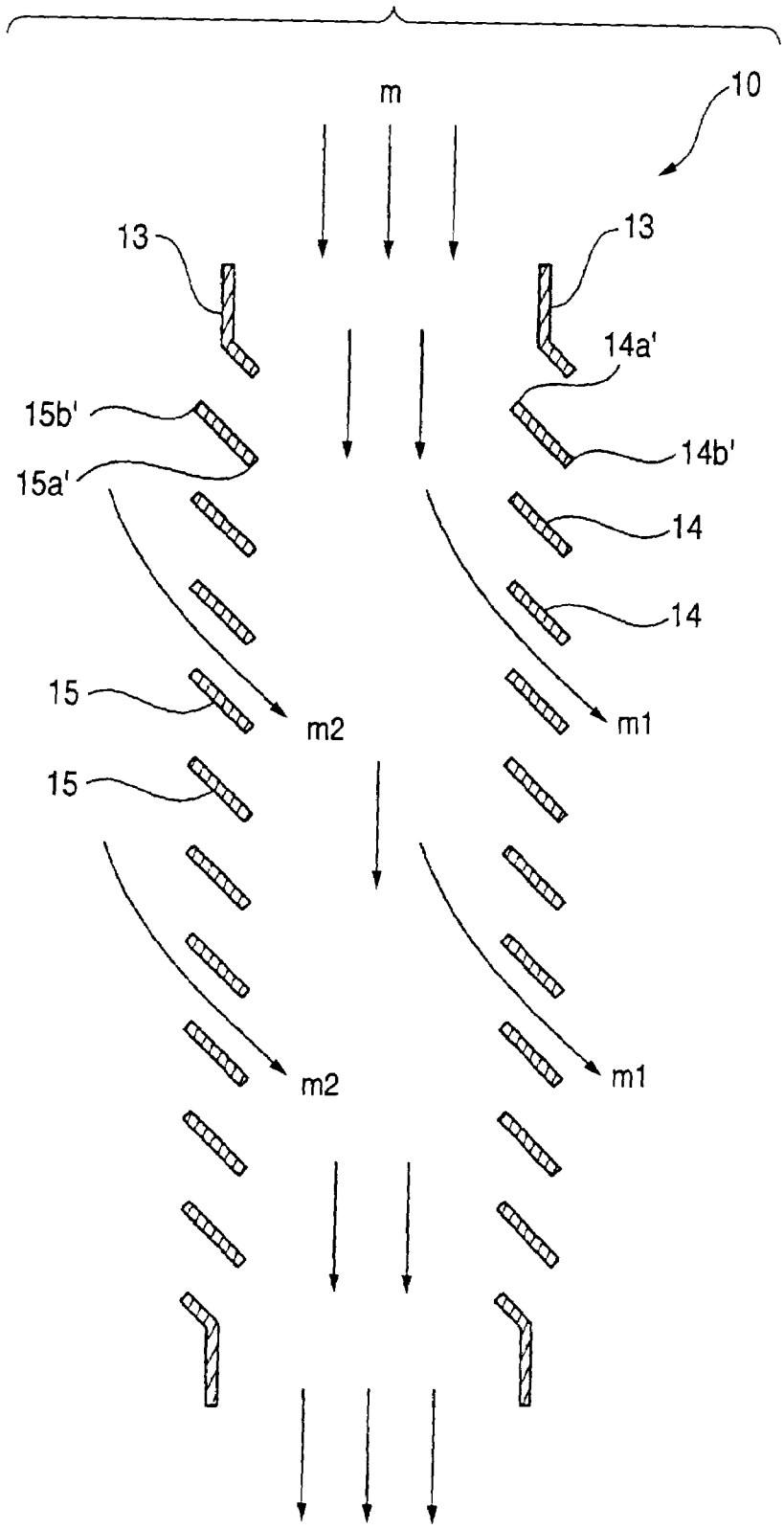
FIG. 2 is an enlarged section view taken along the line II—II in FIG. 1.
Figure 3:
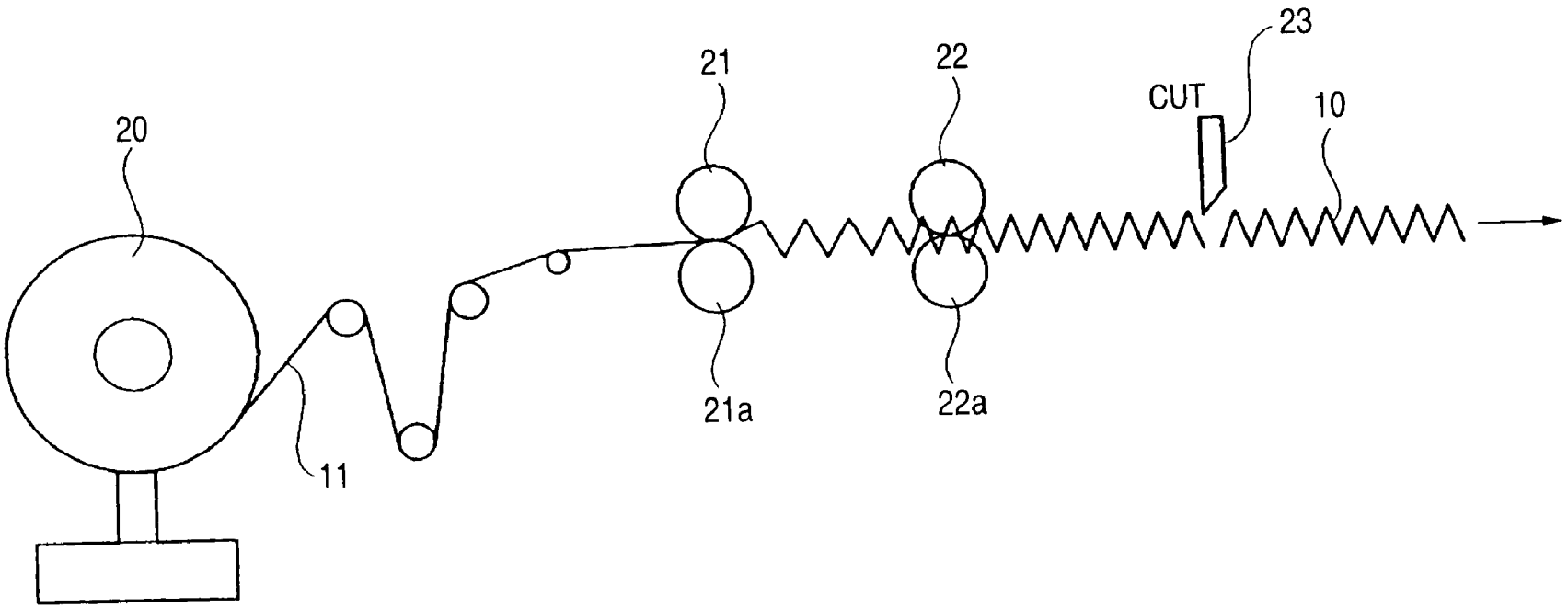
FIG. 3 is a diagram showing steps of shaping the louver fin in the first embodiment of the invention.
Figure 4:
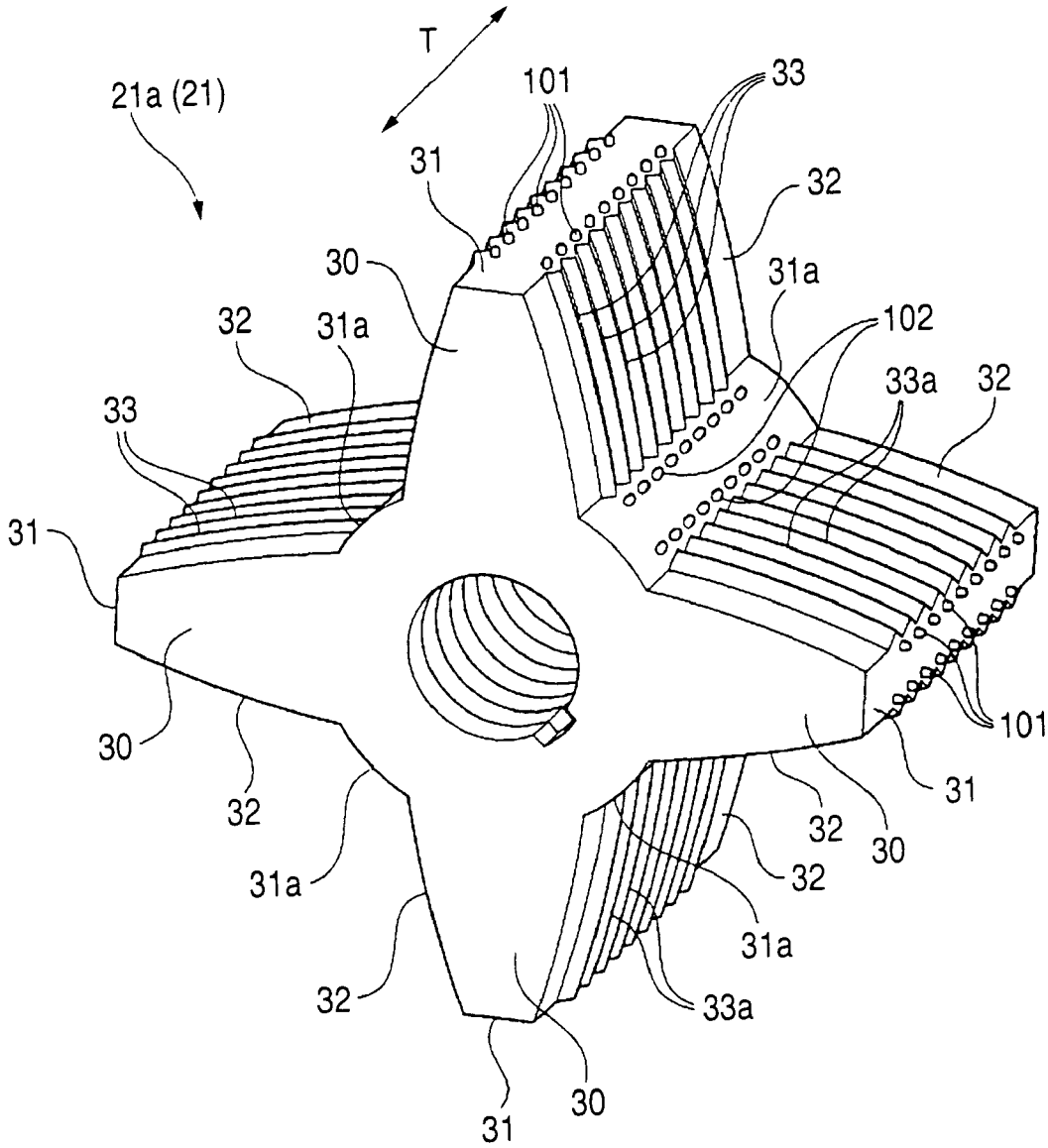
FIG. 4 is a perspective view showing a corrugation cutter in the first embodiment of the invention.
Figure 5A:
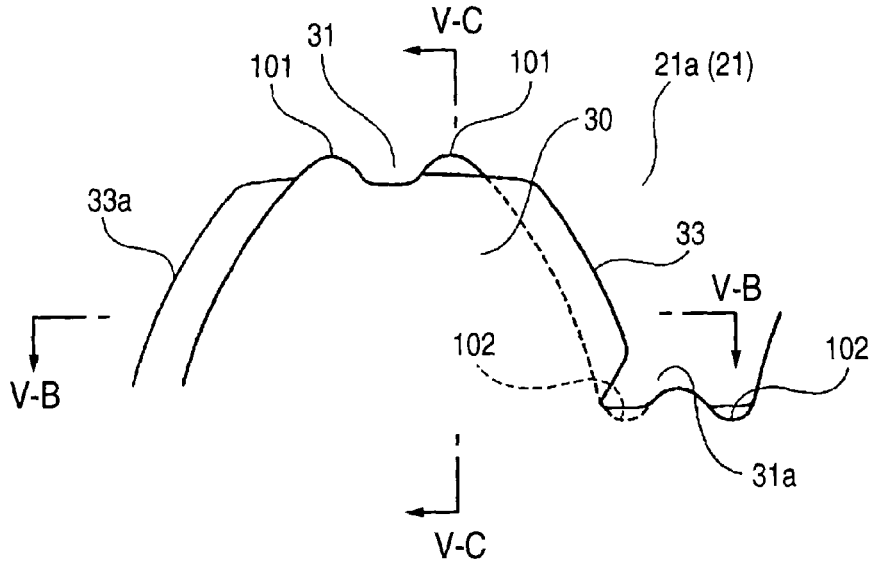
FIG. 5A is an enlarged front view showing one of teeth of the corrugation cutter in the first embodiment of the invention.
Figure 5B:
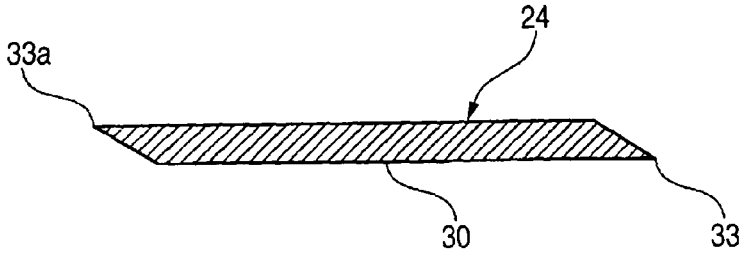
FIG. 5B is a section view taken along the line V-B—V-B in FIG. 5A.
Figure 5C:
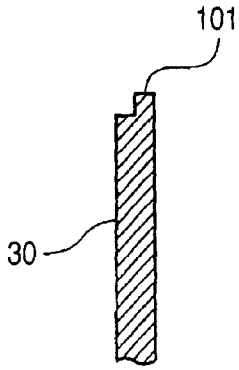
FIG. 5C is a section view taken along the line V-C—V-C in FIG. 5A.
Figure 6:
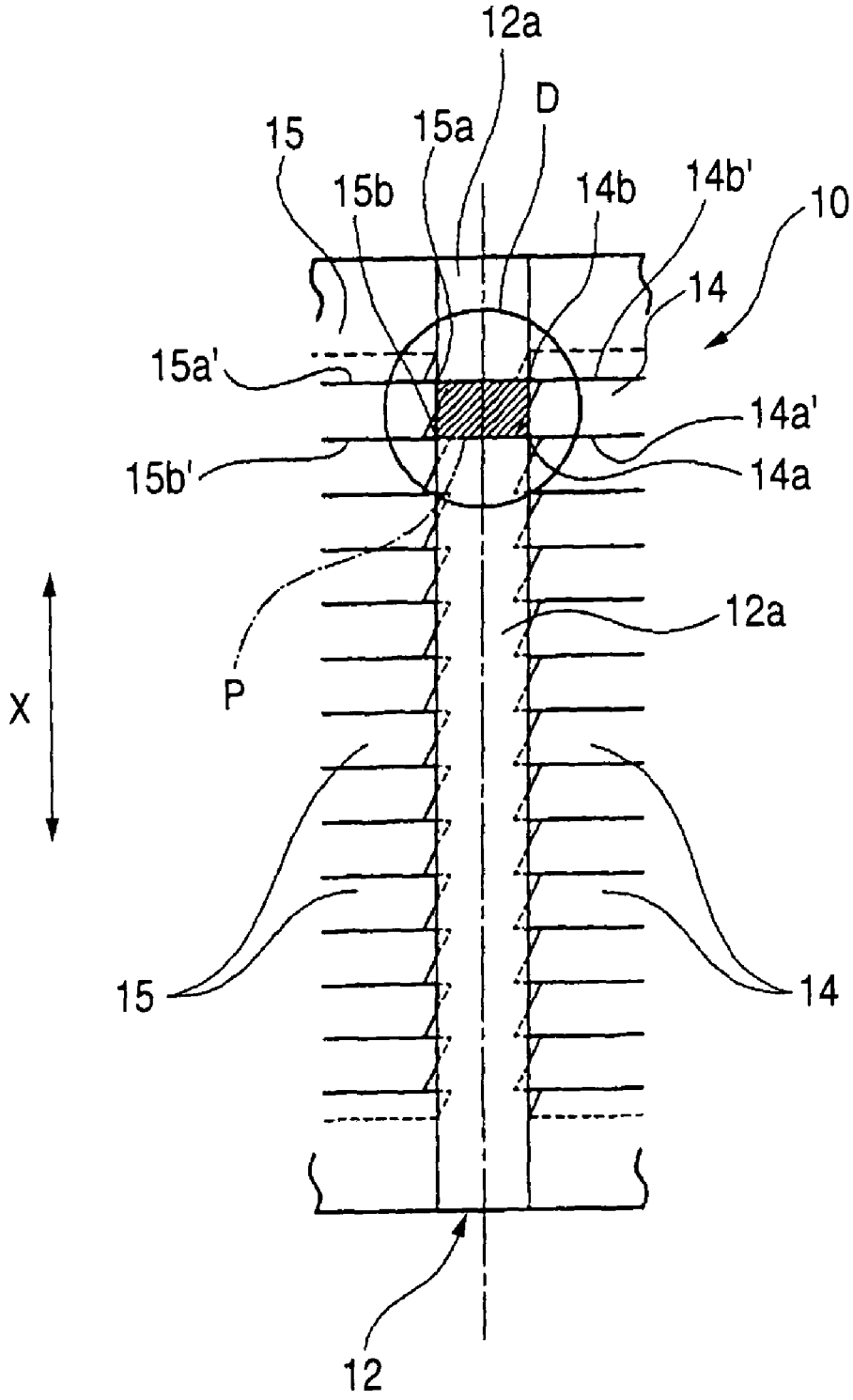
FIG. 6 is a development view of main portions of the louver fin in the first embodiment of the invention.
Figure 7:
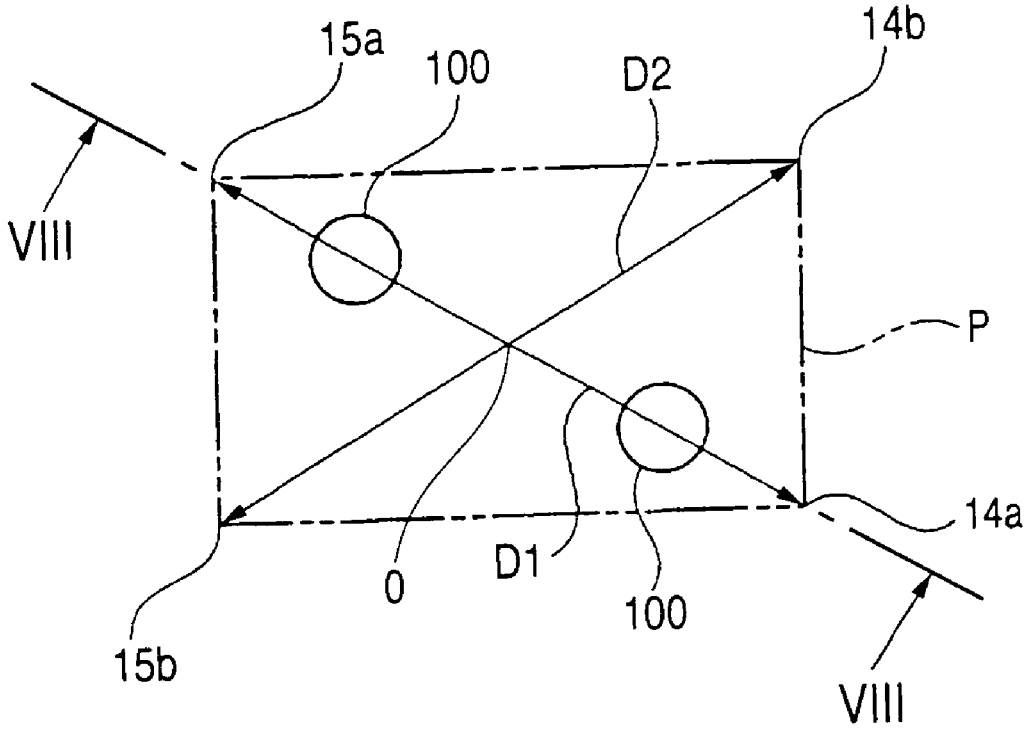
FIG. 7 is an enlarged view of the portion D in FIG. 6.
Figure 8:
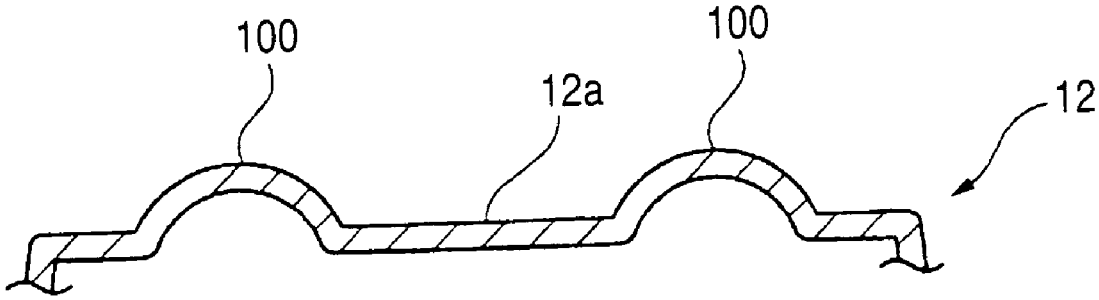
FIG. 8 is an enlarged section view taken along the line VIII—VIII in FIG. 7.

FIGS. 1 to 8 show a first embodiment of a louver fin of the invention, and a corrugation cutter for forming the louver fin. FIG. 1 is a perspective view showing a part of the louver fin, FIG. 2 is an enlarged section view taken along the line II—II in FIG. 1, FIG. 3 is a diagram showing steps of shaping the louver fin, FIG. 4 is a perspective view showing the corrugation cutter, FIG. 5A is an enlarged front view showing one of teeth of the corrugation cutter, FIG. 5B is a section view taken along the line V-B—V-B in FIG. 5A, FIG. 5C is a section view taken along the line V-C—V-C in FIG. 5A, FIG. 6 is a development view of main portions of the louver fin, FIG. 7 is an enlarged view of the portion D in FIG. 6, and FIG. 8 is an enlarged section view taken along the line VIII—VIII in FIG. 7.

As shown in FIG. 1, in the louver fin 10 of the first embodiment, a strip thin sheet 11 made of aluminum is formed into a corrugated shape (bellows-like shape) configured alternately and continuously by a plurality of bent portions 12 and flat portions 13, and, in each of the flat portions 13, plural louvers 14 and 15 that are punched and raised along the longitudinal direction Y of the strip thin sheet 11 are arranged in the width direction X of the strip thin sheet 11.

In this embodiment, as shown in FIG. 2, the raised directions of the louvers 14 which are formed in one of the flat portions 13 that are opposed to each other across the bent portion 12 are opposite to those of the louvers 15 which are formed in the other flat portion.

The louver fin 10 is formed by productions steps shown in FIG. 3. Namely, the strip thin sheet 11 which is reeled out of a roll 20 is passed between paired corrugation cutters 21 and 21*a* which are placed on both the sides of sheet, whereby formation of the bent portions 12 is performed simultaneously with that of the louvers 14 and 15 in the flat portions 13.

While the pitch of the adjacent bent portions 12 is being adjusted by pitch adjusting rolls 22 and 22*a* with applying a resistance to the feeding of a corrugated portion, thereafter, the strip thin sheet is fed to a cutting blade 23 in the next stage to be cut into a predetermined length thereby. As a result, the louver fin 10 of a predetermined length corresponding to the dimensions of a heat exchanger on which the fin is to be mounted is produced.

One of the corrugation cutters 21 and 21*a* functions as a male cutter, and the other cutter as a female cutter so that the cutters are engaged with each other. The one of the cutters, or the corrugation cutter 21*a* will be described with reference to FIG. 4.

The corrugation cutter 21*a* (or 21) has a star-like shape in which a plurality of teeth 30 are radially protruded. As shown in FIG. 1, the bent portions 12 are continuously formed in the strip thin sheet 11 at predetermined intervals by the apexes 31 and the bottoms 31*a* of the teeth 30 which are radially protruded. The louvers 14 and 15 are punched and raised in the flat portions 13 by plural raising edges 33 and 33*a* formed on side faces 32 of the teeth 30.

In the side faces 32 which are positioned respectively on both the sides about the apex 31 (or the bottom 31*a*), the formation directions of the raising edges 33 are opposite to those of the raising edges 33*a* with respect to the thickness direction T of the corrugation cutter 21*a*.

The corrugation cutter 21*a* and the corrugation cutter 21 which are paired therewith are formed into a substantially same shape. The apexes 31 of one of the corrugation cutters 21 and 21*a* mesh with the bottoms 31*a* of the other cutter, and the raising edges 33 and 33*a* of the one cutter are engaged with the raising edges 33 and 33*a* of the other cutter, whereby the louvers 14 and 15 can be punched and raised.

The corrugation cutter 21*a* (or 21) has a predetermined shape as shown in FIG. 5B. Namely, the teeth 30 are formed by stacking thin unit plates 24 having a radial shape, and, as shown also in FIG. 5A, the raising edges 33 and 33*a* for forming one of the louvers 14 and 15 are formed on both sides of each tooth 30 of the respective unit plates 24.

In each of the unit plates 24, a pointed end of the raising edge 33 is placed on one face (the lower face in the figure), and that of the raising edge 33*a* is placed on the other face (the upper face in the figure), so that the teeth 30 of the unit plate 24 has a substantially parallelogram sectional shape as shown in FIG. 5B.

In the flat portions 13 of the louver fin 10 that are opposed to each other across the bent portion 12, the raised directions of the louvers 14 are opposite to those of the louvers 15. As shown in FIGS. 1 and 6, a virtual quadrangle is assumed on the outer surface of the bent portion 12 including an end face 12*a*. The virtual quadrangle has vertexes respectively configured by: inner ends 14*a* and 15*a* which are continued respectively to inner cut end faces 14*a*′and 15*a*′of the louvers 14 and 15 formed in the flat portions 13 that are opposed to each other across the bent portion 12; and outer ends 14*b* and 15*b* which are continued respectively to outer cut end faces 14*b*′and 15*b*′. In this case, distortion generated in the direction of an outer diagonal line D2 connecting the outer ends 14*b* and 15*b* of the virtual quadrangle P as shown in FIG. 7 is larger in amount than that generated in the direction of an inner diagonal line D1 connecting the inner ends 14*a* and 15*a*. This distortion amounts cause the louver fin 10 to be curved.

In the embodiment, as shown in FIG. 7, embosses 100 serving as a distortion adjusting portion are formed in the vicinity of each corners in the inner diagonal line D1 of the virtual quadrangle P, respectively. As shown in FIG. 8, the embosses 100 are exapndingly formed so as to outward protrude from the end face 12*a* of the bent portion 12.

The embosses 100 are shaped by: projections 101 which are formed in the apex 31 of the corrugation cutter 21*a* as shown in FIGS. 4, 5A, and 5C, and which serve as the distortion adjusting portion forming section; and recesses 102 which are formed in the bottom 31*a*, and which serve as the distortion adjusting portion forming section. Also in the other corrugation cutter 21 which is paired with the corrugation cutter 21*a*, although not illustrated, recesses 102 which serve as the distortion adjusting portion forming section are formed in the bottom 31*a* corresponding to the above-mentioned apex 31, and projections 101 which serve as the distortion adjusting portion forming section are formed in the apex 31 corresponding to the above-mentioned bottom 31*a*.

In a corrugation shaping step, therefore, the strip thin sheet 11 is clampingly pressed between the projections 101 of one of the cutters 21 and 21*a*, and the recesses 102 of the other cutter, whereby the embosses 100 are shaped simultaneously with the shaping of the bent portion 12.

In the thus configured louver fin 10 of the first embodiment, as shown in FIG. 2, the raised directions of the louvers 14 which are formed in one of the flat portions 13 that are opposed to each other across the bent portion 12 are opposite to those of the louvers 15 which are formed in the other flat portion. Therefore, an airflow m which is introduced from the front side is smoothly advanced while flowing out (m1) to the outside through one of the opposed flat portions 13 and flowing in (m2) through the other flat portion. As a result, the airflow amount is increased, so that the heat exchange efficiency can be enhanced.

Since the louvers 14 and 15 of the opposed flat portions 13 of the louver fin 10 are raised in opposite directions, the distortion amount of the end face 12*a* of the bent portion 12 in the direction of the outer diagonal line D2 of the virtual quadrangle P is increased. In the fist embodiment, however, the embosses 100 are formed in the direction of the inner diagonal line D1, and hence material deformation is caused so that the inner diagonal line D1 is equalized with the outer diagonal line D2 by the embosses 100.

In the end face 12*a* of the bent portion 12, therefore, the distortion amount in the direction of the inner diagonal line D1 is substantially equalized with that in the direction of the outer diagonal line D2, and the louver fin 10 can be prevented from being curved and rounded as a whole.

In the louver fin 10 of the first embodiment, the linearity of the louver fin 10 which is finally formed in the production step shown in FIG. 3 can be ensured, and hence the louver fin can be mounted on a heat exchanger easily and accurately without providing a mounting machine with extra device, with the result that heat exchangers can be mass-produced.

[Modifications of First Embodiment]

Figure 9A:
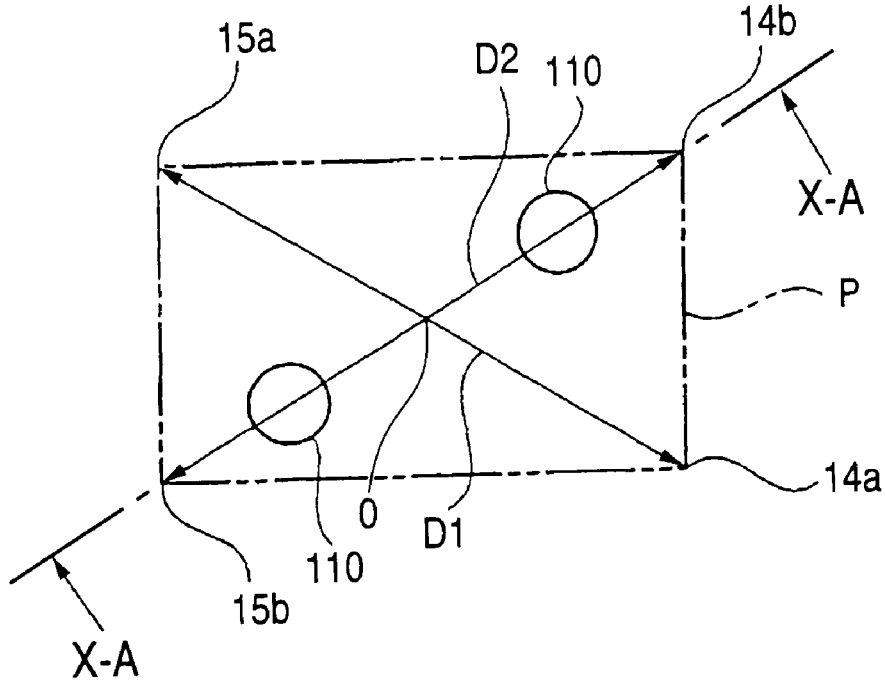
FIG. 9A is an enlarged view of a virtual quadrangle, showing a first modification of the first embodiment of the invention, and corresponding to FIG. 7.
Figure 9B:
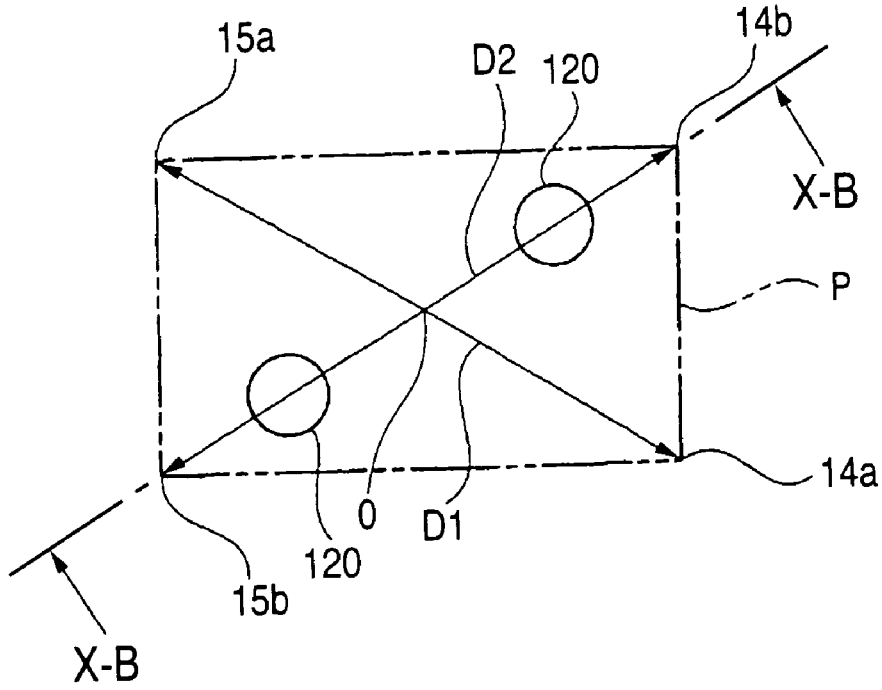
FIG. 9B is an enlarged view of a virtual quadrangle, showing a second modification of the first embodiment of the invention, and corresponding to FIG. 7.
Figure 10A:
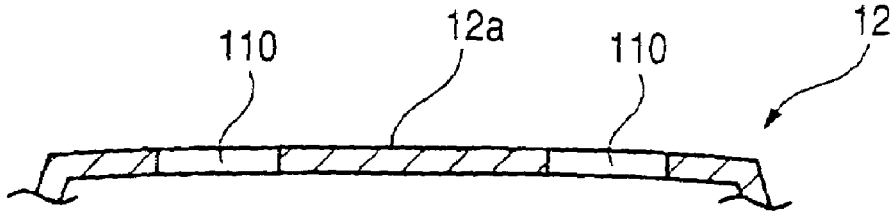
FIG. 10A is an enlarged section view taken along the line X-A—X-A in FIG. 9A, and showing the first modification of the first embodiment of the invention.
Figure 10B:
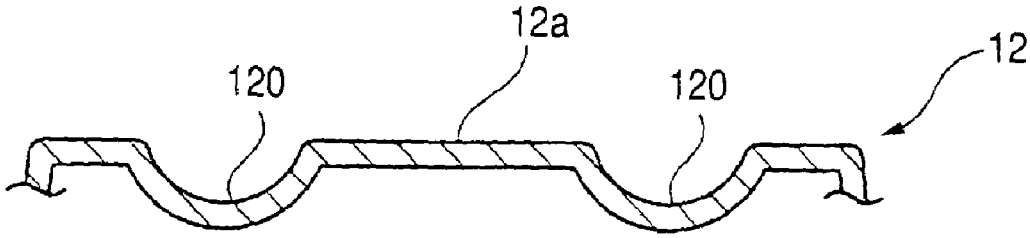
FIG. 10B is an enlarged section view taken along the line X-B—X-B in FIG. 9B, and showing the second modification of the first embodiment of the invention.

FIGS. 9A, 9B, 10A and 10B show modifications of the first embodiment. The components identical with those of the first embodiment are denoted by the same reference numerals, and duplicated description will be omitted. FIGS. 9A and 9B are enlarged views corresponding to FIG. 7 and showing a virtual quadrangle, and FIG. 10A is an enlarged section view taken along the line X-A—X-A in FIG. 9A, and FIG. 10B is an enlarged section view taken along the line X-B—X-B in FIG. 9B.

[First Modification of First Embodiment]

In a first modification, as shown in FIGS. 9A and 10A, openings 110 which serve as a distortion adjusting portion are formed in the vicinity of each corners in the outer diagonal line D2 of the virtual quadrangle P, respectively.

In the louver fin 10 of the modification, the openings 110 function as a stress absorbing portion to reduce distortion in the direction of the outer diagonal line D2, and therefore the distortion amount in the direction of the outer diagonal line D2 can be substantially equalized with that in the direction of the inner diagonal line D1, whereby the louver fin 10 can be prevented from being curved.

[Second Modification of First Embodiment]

In a second modification, as shown in FIGS. 9B and 10B, debosses 120 which serve as a distortion adjusting portion are formed in the vicinity of each corners in the outer diagonal line D2 of the virtual quadrangle P, respectively.

In the louver fin 10 of the modification, the debosses 120 function as a stress absorbing portion to reduce distortion in the direction of the outer diagonal line D2, and therefore the distortion amount in the direction of the outer diagonal line D2 can be substantially equalized with that in the direction of the inner diagonal line D1, whereby the louver fin 10 can be prevented from being curved.

Since the debosses 120 are concavely formed, the debosses 120 do not obstruct the work of mounting the louver fin 10 on a heat exchanger, and the bent portion 12 can be closely brazed closely to the heat exchanger.

[Second Embodiment]

Figure 11A:
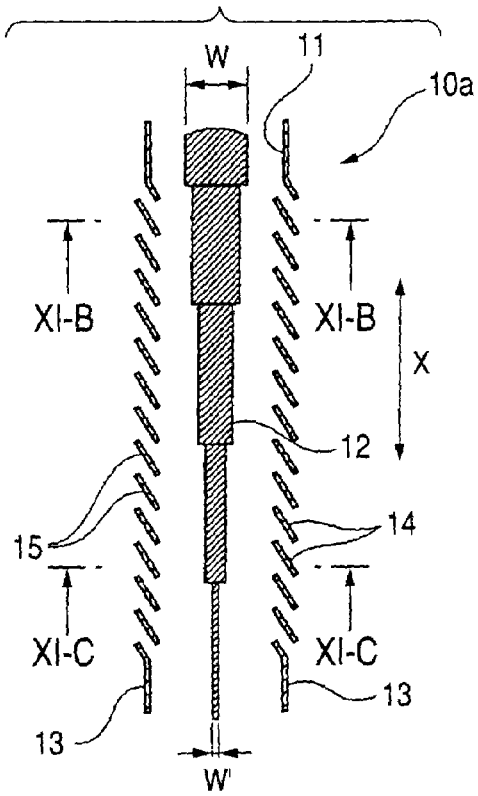
FIG. 11A is a transverse section view showing relationships between opposed louvers and a bent portion in a second embodiment of the invention.
Figure 11B:
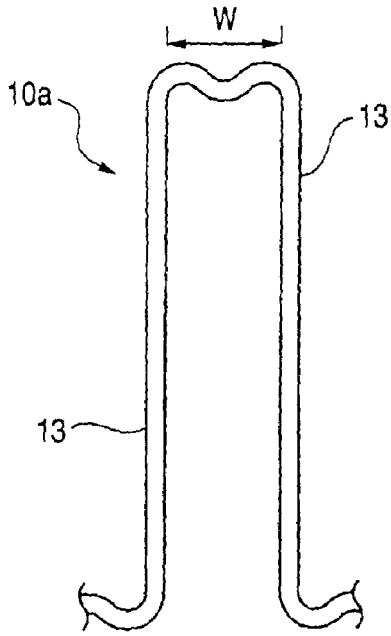
FIG. 11B is a section view of a portion corresponding to the line XI-B—XI-B in FIG. 11A.
Figure 11C:
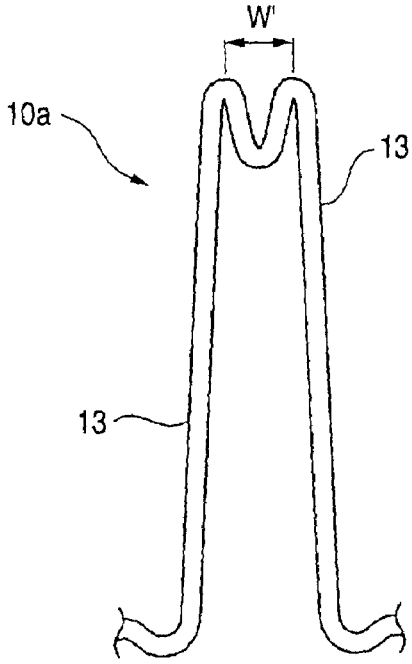
FIG. 11C is a section view of a portion corresponding to the line XI-C—XI-C in FIG. 11A.

FIG. 11 shows a second embodiment of the invention. The components identical with those of the embodiment described above are denoted by the same reference numerals, and duplicated description will be omitted. FIG. 11A is a transverse section view showing relationships between the opposed louvers and the bent portion, FIG. 11B is a section view of a portion corresponding to the line XI-B—XI-B in FIG. 11A, and FIG. 11C is a section view of a portion corresponding to the line XI-C—XI-C in FIG. 11A.

In a louver fin 10*a* of the second embodiment, as shown in FIG. 11, the width W of the bent portion 12 is changed in a direction along which curve of the fin 10*a* is corrected in the width direction X of the strip thin sheet 11.

Specifically, as shown in FIG. 11B, the width W is made larger in the inner side of the curve caused by apex twist of the louver fin 10*a*, i.e., the side of a larger curvature (the upper side in FIG. 11A), and, as shown in FIG. 11C, the width is made smaller in the outer side of the curve, i.e., the side of a smaller curvature (the lower side in FIG. 11A).

In FIG. 11A, the width W (indicated by the hatched portion in the figure) of the bent portion 12 is stepwise changed in the width direction X of the strip thin sheet 11.

In the embodiment, the width W of the bent portion 12 of the louver fin 10*a* is made larger in the inner side of the curve of the louver fin 10*a*, and made smaller in the outer side of the curve. As a result, the curve of the louver fin 10*a* can be corrected, so that the linearity can be ensured.

[Modification of Second Embodiment]

Figure 12:
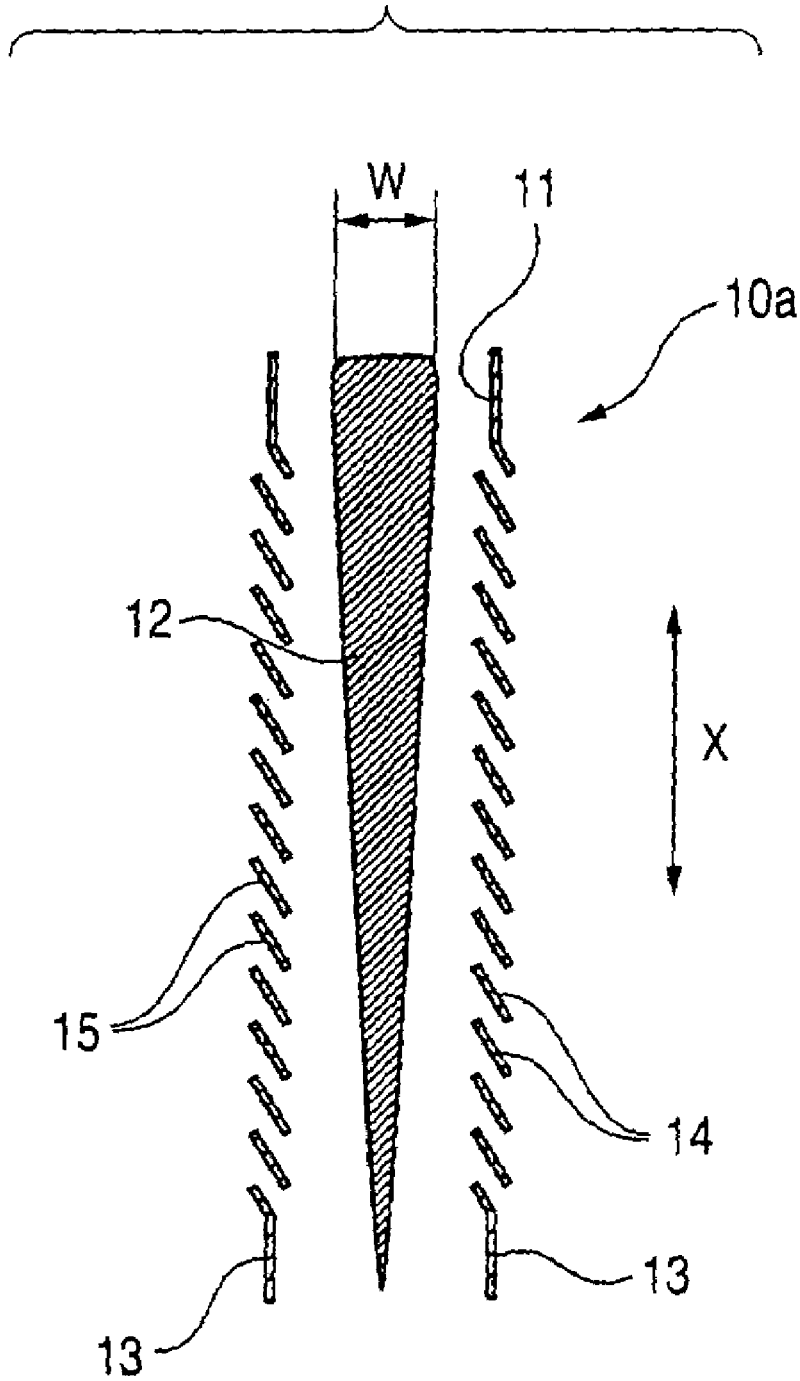
FIG. 12 is a section view showing a modification of the second embodiment of the invention, and corresponding to FIG. 11A.

FIG. 12 shows a modification of the second embodiment. The components identical with those of the embodiments described above are denoted by the same reference numeral, and duplicated description will be omitted. FIG. 12 is a section view corresponding to FIG. 11A.

In the modification, in the same manner as the second embodiment, the width W of the bent portion 12 is made larger in the inner side of the curve of the louver fin 10*a*, and made smaller in the outer side of the curve. As shown in FIG. 12, particularly, the width W (indicated by the hatched portion in the figure) is continuously changed in the width direction X of the strip thin sheet 11.

In the louver fin 10*a* of the modification, therefore, it is a matter of course that the curve of the louver fin 10*a* can be corrected and the linearity can be ensured in the same manner as the second embodiment, and moreover the curve correction is smoothly performed because the width W is continuously changed, with the result that the linearity of the louver fin 10*a* can be obtained more accurately.

[Third Embodiment]

Figure 13A:
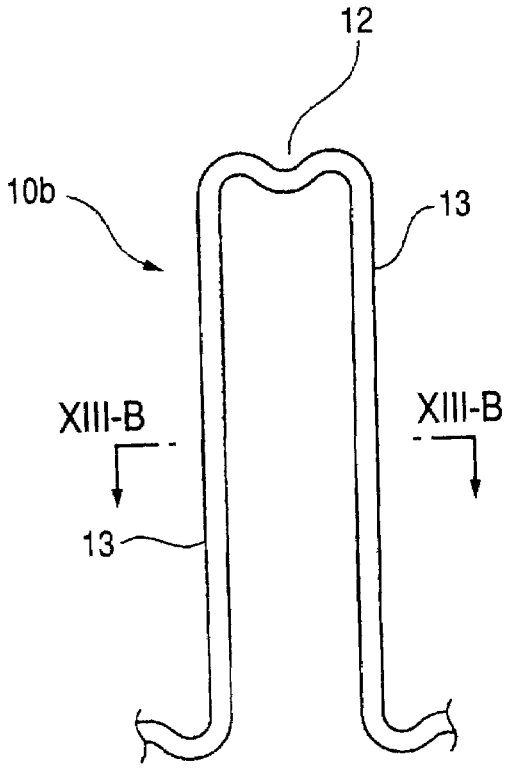
FIG. 13A is a side view of a louver fin in a third embodiment of the invention.
Figure 13B:
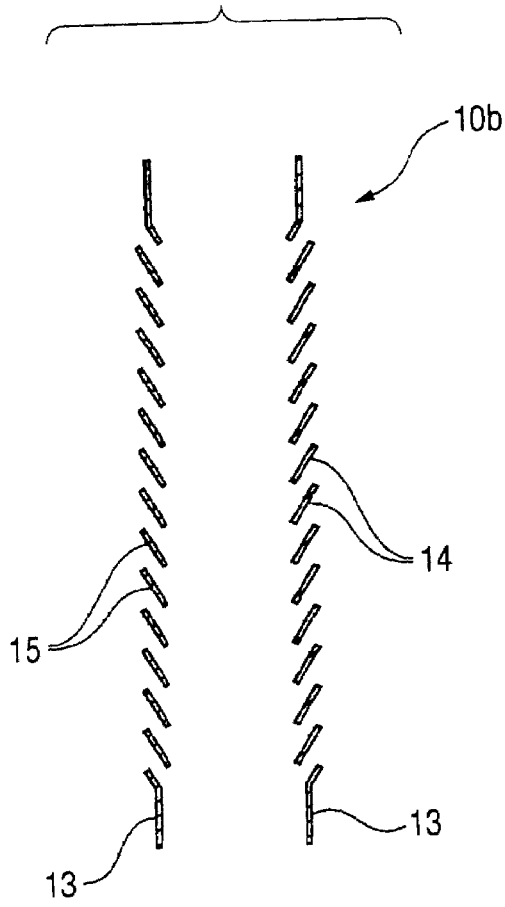
FIG. 13B is a section view taken along the line XIII-B—XIII-B.
Figure 14A:
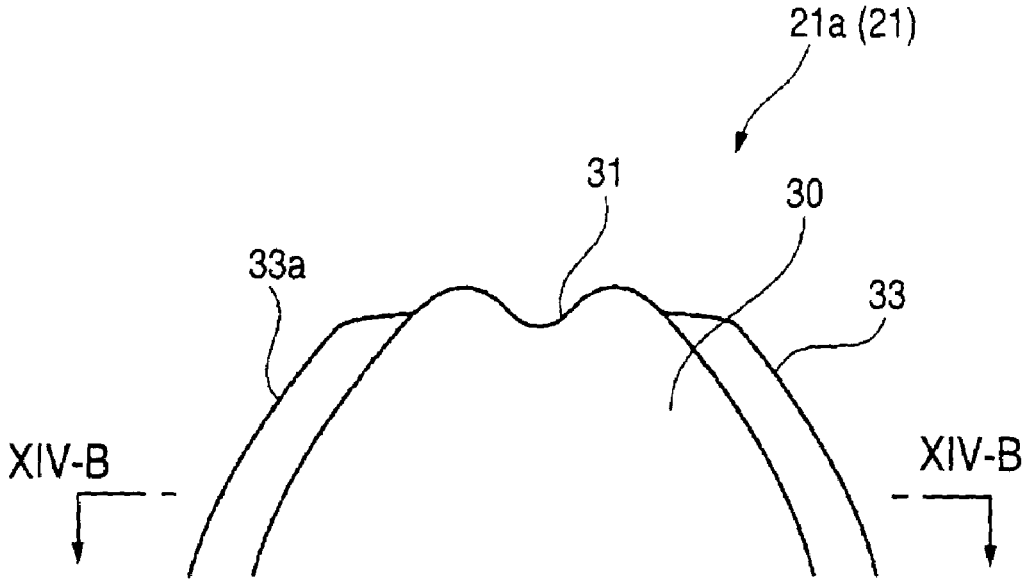
FIG. 14A is an enlarged front view showing one of teeth of a corrugation cutter in the third embodiment of the invention.
Figure 14B:
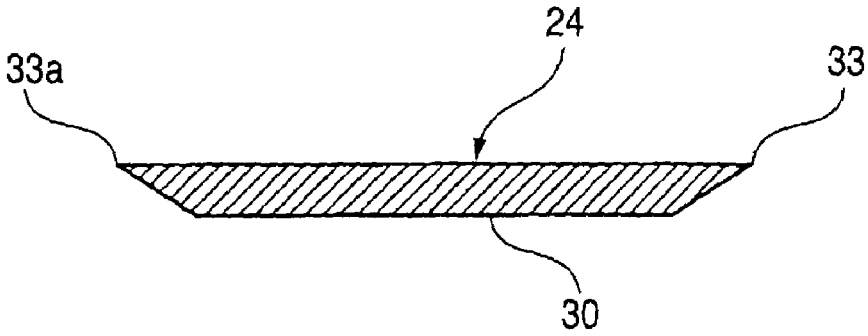
FIG. 14B is a section view taken along the line XIV-B—XIV-B in FIG. 14A.
Figure 15:
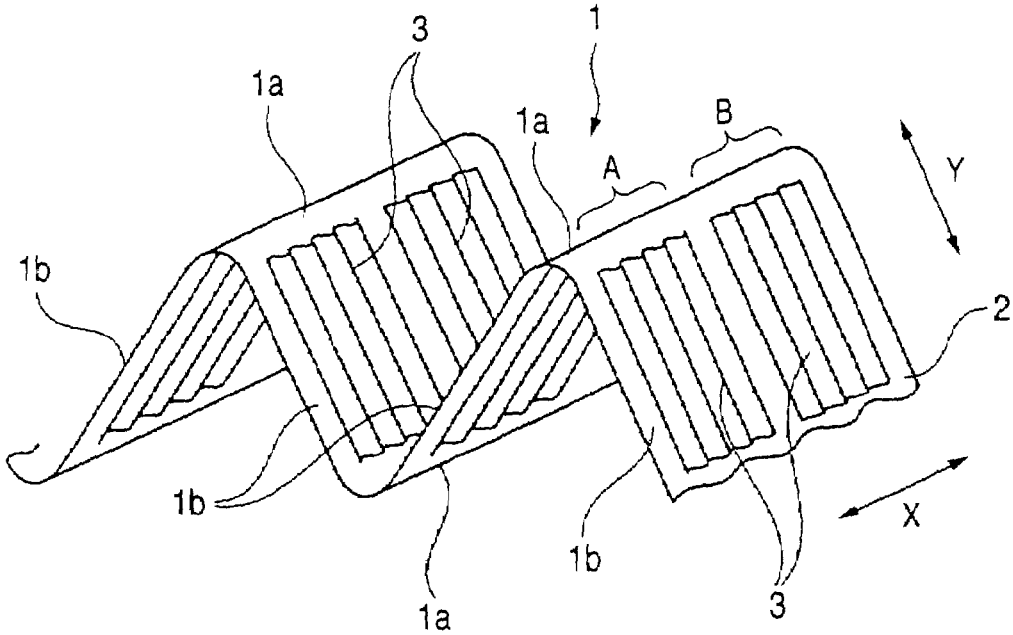
FIG. 15 is a perspective view showing a part of a conventional louver fin.
Figure 16:
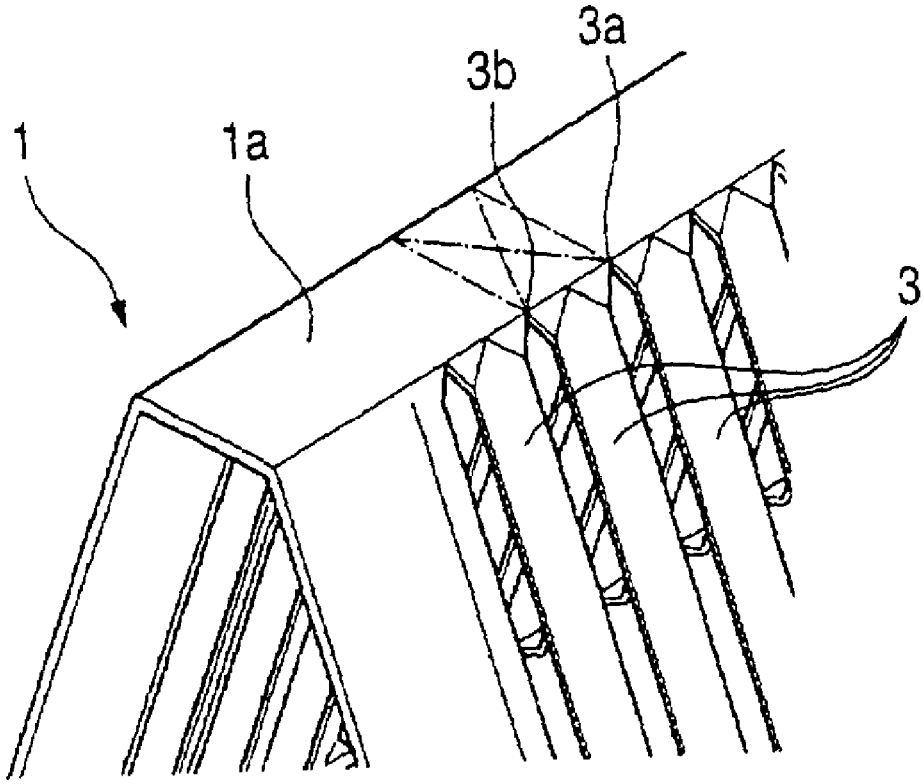
FIG. 16 is an enlarged perspective view of main portions of the conventional louver fin.
Figure 17:
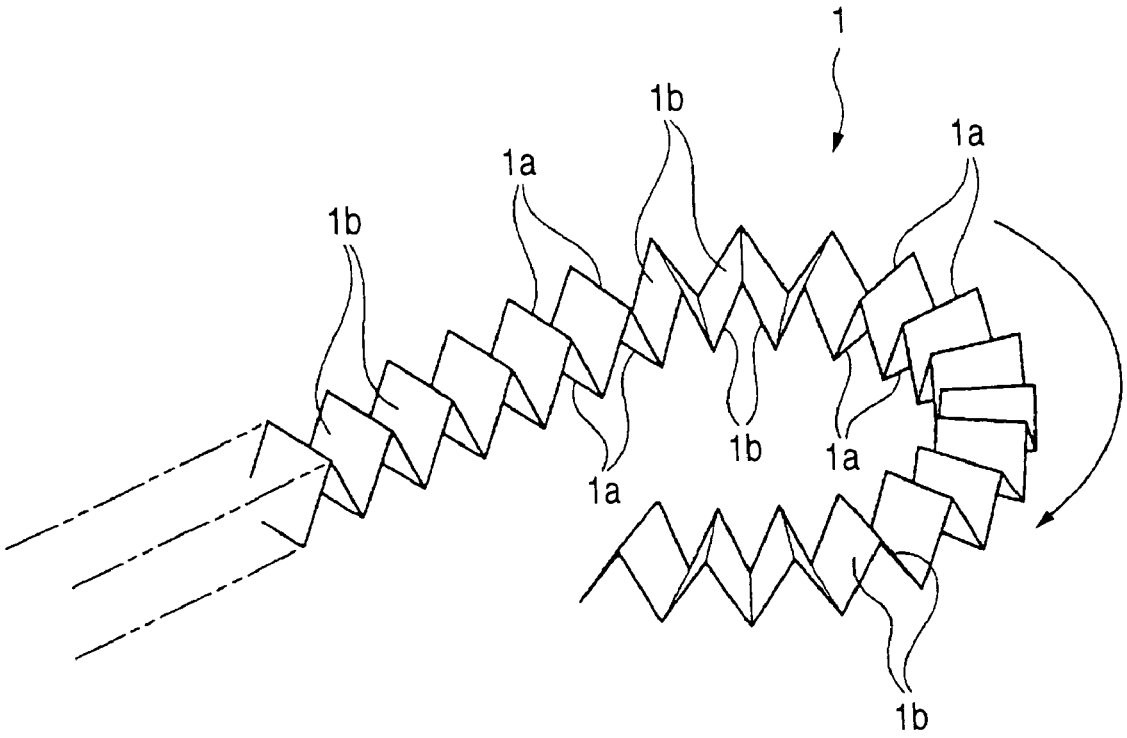
FIG. 17 is a perspective view showing a curved state of the conventional louver fin.

FIGS. 13 and 14 show a third embodiment of the invention. The components identical with those of the embodiments described above are denoted by the same reference numerals, and duplicated description will be omitted. FIG. 13A is a side view of a louver fin, FIG. 13B is a section view taken along the line XIII-B—XIII-B in FIG. 13A, FIG. 14A is an enlarged front view showing one of teeth of a corrugation cutter, and FIG. 14B is a section view taken along the line XIV-B-XIV-B in FIG. 14A.

In a louver fin 10*b* of the third embodiment, as shown in FIG. 13, the raised directions of the louvers 14 and 15 which are opposed to each other, and which are formed in the flat portions 13 that are opposed to each other across the bent portion 12 are symmetrical about the bent portion 12.

In the embodiment, as shown in FIG. 14, the pointed ends of the raising edges 33 and 33*a* of the corrugation cutter 21*a* (or 21) are placed on only one side face of each of the unit plates 24, and the tooth 30 of each unit plate 24 has a substantially trapezoidal sectional shape as shown in FIG. 14B.

In the louver fin 10*b* of the third embodiment, since the raised directions of the louvers 14 and 15 which are formed in the flat portions 13 that are opposed to each other across the bent portion 12 are symmetrical about the bent portion 12, also the outer cut end faces 14*b*′and 15*b*′of the louvers 14 and 15 which cause distortion are symmetrical about the bent portion 12. Therefore, distortions which are generated in the bent portion 12 can be offset against each other, so that the louver fin 10*b* can be prevented from being curved.

In the first, second, and third embodiments, the cases have been described where the invention is applied to the louver fins 10, 10*a*, and 10*b* in which the louvers 14 or 15 in each flat portion 13 are raised in the same direction. The invention is not restricted to the embodiments described above, and may be applied to a louver fin in which, as described in the conventional art paragraph, louvers of different raised directions are mixedly placed in each flat portion, so that apex twist can be prevented from occurring.

Although the invention has been described with taking the first, second, and third embodiments as examples, the invention is not restricted to the embodiments. The invention can be implemented in various embodiments without departing from the spirit of the invention.

What is claimed is:

1. A louver fin in which a strip thin sheet is formed into a continuous corrugated shape configured by alternate bent portions and flat portions, and, in each of the flat portions, a plurality of louvers that are punched and raised along a longitudinal direction of the strip thin sheet are arranged in a width direction of the strip thin sheet, comprising:

a distortion adjusting portion disposed in each of the bent portions, wherein a virtual quadrangle being assumed, the virtual quadrangle having vertexes respectively configured by: inner ends which are located respectively at a corner of inner cut end faces of the louvers formed in flat portions that are opposed to each other across the bent portion; and outer ends which are located respectively at a corner of outer cut end faces of the louvers, wherein the distortion adjusting portion equalizes a distortion generated in a direction of an inner diagonal line connecting said inner ends of the virtual quadrangle, with distortion generated in a direction of an outer diagonal line connecting said outer ends, the distortion adjusting portion being arranged along one of the inner diagonal line or the outer diagonal line.

2. The louver fin as claimed in claim 1, wherein the distortion adjusting portion is configured by embosses which are formed in the vicinity of each corners in the direction of the inner diagonal line of the virtual quadrangle, respectively.

3. The louver fin as claimed in claim 1, wherein the distortion adjusting portion is configured by openings which are formed in the vicinity of each corners in the direction of the outer diagonal line of the virtual quadrangle, respectively.

4. The louver fin as claimed in claim 1, wherein the distortion adjusting portion is configured by debosses which are formed in the vicinity of each corners in the direction of the outer diagonal line of the virtual quadrangle, respectively.

5. A louver fin in which a strip thin sheet is formed into a continuous corrugated shape configured by alternate bent portions and flat portions, and, in each of the flat portions, a plurality of louvers that are punched and raised along a longitudinal direction of the strip thin sheet are arranged in a width direction of the strip thin sheet, comprising:

a distortion adjusting portion disposed in each of the bent portions, wherein a virtual quadrangle being assumed, the virtual quadrangle having vertexes respectively configured by: inner ends which are located respectively at a corner of inner cut end faces of the louvers formed in flat portions that are opposed to each other across the bent portion; and outer ends which are located respectively at a corner of outer cut end faces of the louvers, wherein the distortion adjusting portion equalizes a distortion generated in a direction of an inner diagonal line connecting said inner ends of the virtual quadrangle, with distortion generated in a direction of an outer diagonal line connecting said outer ends, wherein the distortion adjusting portion is configured by embosses which are formed in the vicinity of each corners in the direction of the inner diagonal line of the virtual quadrangle, respectively.

* * * * *